United States Patent [19]

Barradas

[11] 4,298,787

[45] Nov. 3, 1981

[54] APPARATUS FOR HEATING AND SETTING HAIR

[75] Inventor: George Barradas, Greenwich, Conn.

[73] Assignee: Appliance Design Probe Inc., Scarborough, Canada

[21] Appl. No.: 108,649

[22] Filed: Jan. 17, 1980

[51] Int. Cl.[3] ..... H05B 1/00; A45D 4/12

[52] U.S. Cl. ..... 219/222; 132/9; 132/33 R; 132/36 R; 219/242; 219/401; 219/521

[58] Field of Search ..... 219/222–226, 219/242, 214, 521, 401; 132/7, 9, 33 R–33 G, 36 R–36 D

[56] References Cited

U.S. PATENT DOCUMENTS

| | | | |
|---|---|---|---|
| 3,473,005 | 10/1969 | Grandinetti | 219/222 |
| 3,665,939 | 5/1972 | Laing | 219/242 X |
| 3,705,974 | 12/1972 | Nilsson | 219/242 X |
| 3,784,784 | 1/1974 | Geominy et al. | 219/242 X |
| 3,858,029 | 12/1974 | Walter | 219/222 |

FOREIGN PATENT DOCUMENTS

| | | | |
|---|---|---|---|
| 2104794 | 11/1971 | Fed. Rep. of Germany | 219/242 |
| 804992 | 8/1936 | France | 219/242 |
| 546715 | 7/1956 | Italy | 219/242 |
| 503975 | 4/1939 | United Kingdom | 219/242 |
| 581101 | 10/1946 | United Kingdom | 219/242 |
| 665180 | 1/1952 | United Kingdom | 219/242 |

*Primary Examiner*—A. Bartis

*Attorney, Agent, or Firm*—Shoemaker and Mattare, Ltd.

[57] ABSTRACT

There is provided a compact apparatus for heating and setting hair, including a housing, a central wall in the housing defined by two spaced-apart panels, a plurality of elongated members passing through the central wall perpendicularly and extending to both sides thereof within the housing, and a flexible rope-like heating element between the two spaced-apart panels and wound around each of the elongated members, in order to provide heat thereto. The apparatus includes a number of hair-curling cylinders of conventional construction adapted to fit over the ends of the elongated members. By providing this construction, a single elongated member serves as two heating posts for two of the hair-curling cylinders, and the overall construction is relatively compact compared to prior devices. A reservoir for water is situated in the central wall, and heat from the heating element vaporizes the water to provide steam within the housing around the curling cylinders on the elongated members.

10 Claims, 3 Drawing Figures

APPARATUS FOR HEATING AND SETTING HAIR

This invention relates to an apparatus for heating and setting hair, and has to do particularly with a compact apparatus having a novel construction the simplicity of which allows a cost saving.

Many apparatuses for heating and setting hair are already known, in which hair rollers made of a heatretentive material are first heated in a box or container, and then the hair is wound around the roller and allowed to set. One common way for these rollers to be heated is to provide them with an internal axial bore, and to fit them over heating posts in the heating apparatus, the posts being heated by various means, including primarily the provision of electrically energized resistance units within the posts. A typical example of this known construction in U.S. Pat. No. 3,705,974 to Nilsson, issued Dec. 12, 1972 on "Hair Setting Apparatus." In the Nilsson reference, a heating cable has portions which extend in looped configuration into the heating posts, the latter being closed at the end distal from a mounting plate to which they are fixed and from which they extend vertically upwardly.

It is customary to provide approximately 20 such heating rollers and 20 corresponding heating posts in a typical hair setting unit, and such provision involves fairly complex securement arrangements between the heating posts and the base plate, in addition to providing 20 specific connections.

This prior art arrangement just described involves the disadvantage of higher cost due to its complexity, and it is an aspect of the present invention to simplify the construction of such an apparatus while still retaining the same number of heating posts and having the same capacity in terms of the number of rollers utilized. In addition to simplification, this invention is aimed at providing a relatively compact design taking up the smallest possible amount of space considering the necessity of housing 20 rollers.

Accordingly, this invention provides a compact apparatus for heating and setting hair.

A central wall is defined by two spaced-apart panels, and a plurality of heat-conductive elongated members pass through separate pairs of aligned apertures in said panels. Each elongated member extends away from the central wall in two opposing directions. A plurality of hair-curling cylinders are provided, having central axial passageways adapted to receive ends of said elongated members. A flexible rope-like heating element is positioned between the two spaced-apart panels wound around each of the elongated members, and wire means is provided by which electrical energy can be conveyed to the heating element from an external source. A housing means encloses the central wall, the elongated members, the heating element, and the cylinders when engaged with the elongated members.

In a preferred embodiment, the elongated members defined above are hollow, open-ended, metallic tubes. These tubes may be of aluminum.

Also in a preferred embodiment, the housing means is adapted to rest upon any supporting surface in a given orientation, the central wall being perpendicular to the supporting surface when the housing means is in that orientation.

Also in a preferred embodiment, the apparatus may further include an upwardly open metallic reservoir for water located in an edge of the central wall which is uppermost when the housing means is in the orientation defined above. In this manner, heat generated by the heating element can rise and vaporize water in the reservoir. The apparatus is so constructed that water vapor from the reservoir can pass into those parts of the housing means which enclose the free ends of the elongated members. The housing means incudes an opening directly above the reservoir for allowing water to be added to the reservoir, and a closure member which can be moved manually between a position in which it closes the opening and a position in which it leaves the opening open.

Finally, in a preferred embodiment, each of the two spaced-apart panels making up the central wall has flanged edge portions, and these flanged edge portions of each panel extend toward the other panel. Peripheries of the edge portions of the panels are in juxtaposition.

One embodiment of this invention is illustrated in the accompany drawings, in which like numerals denote like parts throughout the several views, and in which.

Figure 1:
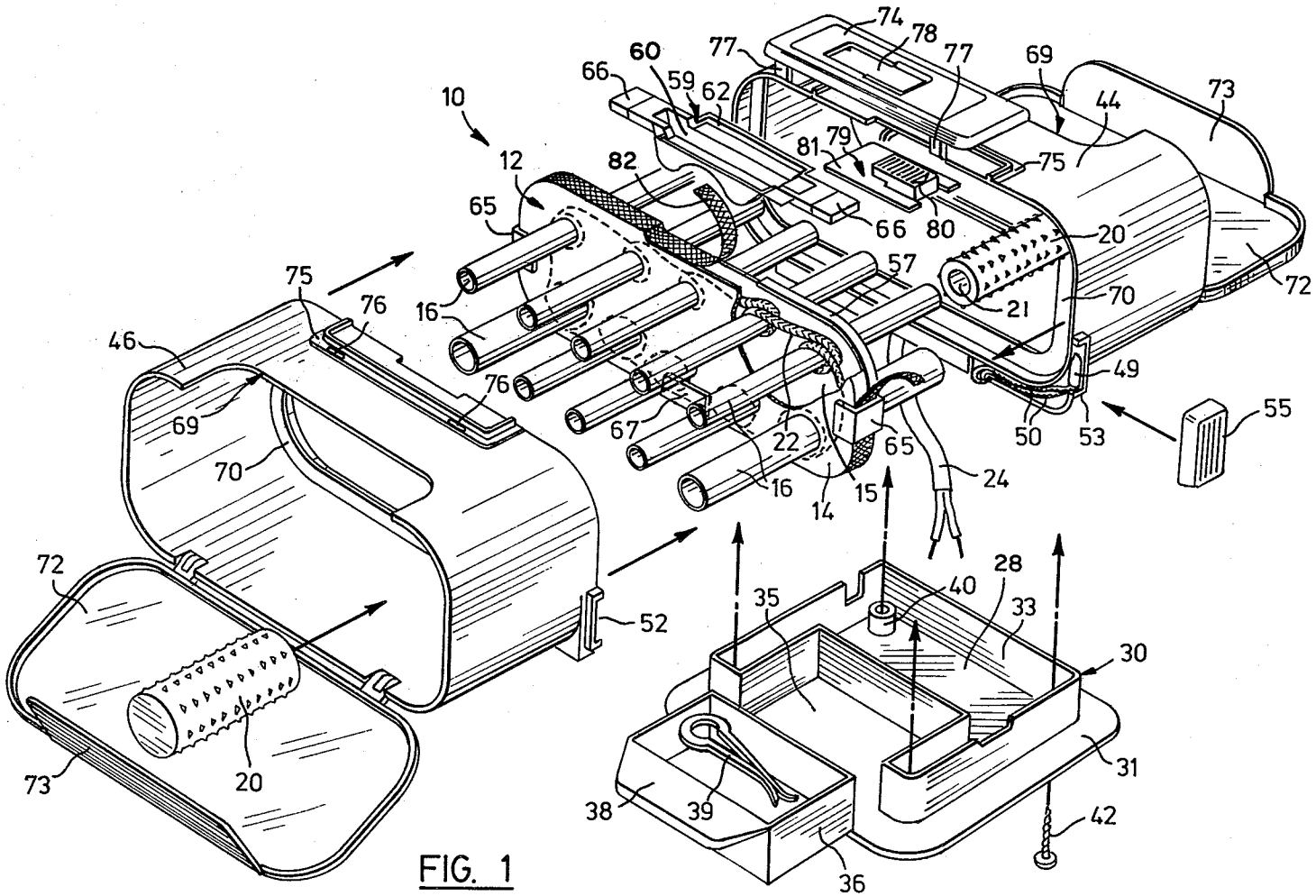
FIG. 1 is a partly broken away, perspective, exploded view of an apparatus constructed in accordance with this invention.

Turning first to FIG. 1, a compact apparatus shown generally at 10 is seen to include a central wall 12 which is defined by two spaced-apart panels 14 and 15, a plurality of heat-conductive elongated members 16, each one passing through a separate pair of aligned apertures 18 in the panels 14 and 15, and each elongated member extending away from the central wall 12 in two opposing directions. More specifically, the elongated members are situated perpendicular to the central wall 12.

The wall 12 and the elongated members 16 will be described in greater detail below.

Basically, the apparatus 10 further includes a plurality of hair-curling cylinders 20 each of which has a central blind passageway 21 adapted to receive an end of an elongated member 16. A flexible, rope-like heating element 22 is located between the two spaced-apart panels 14 and 15, and thus within the body of the central wall 12, and is wound around each of the elongated members 16. This is clearly seen in FIG. 1.

Electrical wire means are further provided by which electrical energy can be conveyed to the heating element 22 from an external source, for example the AC power available in the typical house outlet in the wall. The wire means is identified in FIG. 1 by the numeral 24.

A housing 25 (made of several components subsequently to be described) encloses the central wall 12, the elongated members 16, the heating element 22, and the cylinders 20 when the latter are engaged with the elongated members 16.

Turning more specifically to the components shown in the figures, the elongated members 16 are hollow, open-ended, metallic tubes, preferably of aluminum, and are of various diameters, in accordance with present preferred designs for hair setting equipment. The larger the diameter, the larger the roller which is adapted to fit over it. Thus, in FIG. 1, it will be seen that there are two large-diameter elongated members at the bottom outside positions, and that the remaining elongated members are all of the same, smaller diameter. It can further be seen, particularly in FIG. 2, that each of the elongated members 16 extends equally to both sides of the central wall 12, and that each is perpendicular thereto. The central wall 12 is adapted to be oriented vertically (i.e. in a vertical plane) when the housing is in its usual orientation, the latter being that shown in FIG. 2.

Referring again to FIG. 1, the wire means 24 enters the main housing through an opening 27 from a compartment 28 in a pedestal portion 30 which is best seen in FIG. 1. The pedestal portion 30 has a base flange 31 which extends outwardly and downwardly from a wall portion 33 which defines a open U-shaped configuration, the "U" allowing a drawer space 35 into which a small drawer 36 of rectangular configuration can be fitted. The drawer 36 has a gripping tab 38, and is intended to contain hair clips, of which one is shown at 39 in FIG. 1. The pedestal portion 30 includes integral bosses 40 at its four corners (only one visible in FIG. 1), through which conventional threaded fasteners 42 can be passed from underneath, such that they can enter and screw tightly into aligned bosses 43 on the underside of the two main housing portions 44 and 46.

Returning to the wire 24, the latter enters through the opening 27 as aforesaid, passes into the centre of the central wall 12 between the panels 14 and 15 through an appropriate opening at the base thereof, and is connected directly across the heating element 22, the latter being in parallel with a neon indicator bulb 49 seen in FIG. 1, through appropriate wires 50. The neon indicator bulb 49 is positioned in a small rectangular cavity defined between the two half cavities 52 and 53 provided on each of the housing portions 46 and 44, respectively, and defined by two C-shaped flanges that can be seen in FIG. 1. A transparent closure 55 is adapted to snap over the last-mentioned flanges, to enclose and protect the neon indicator 49.

If desired, a switch may be incorporated into the apparatus, although such has not been illustrated in the embodiment shown in the figures.

Returning again to the central wall 12, the panels 14 and 15 which constitute the central wall 12 have marginal flanges 57*a* and 57 respectively, directed perpendicularly to their main extent, each flange projecting toward the other panel. In FIG. 1, a portion of the nearer panel 14 has been broken away, so that the marginal flange 57 of the panel 15 can be seen. The marginal flange of each of the panels 14 and 15 extends around the full periphery of its respective panel except for a part near the top centre of each panel, as can be clearly seen in FIG. 1. Furthermore, the individual panels 14 and 15 are recessed or downwardly indented at this same location, in order that a metallic reservoir 59 can be positioned at this location. The metallic reservoir is upwardly open, and has an elongated, relatively deep trough 60 which is adapted to fit snugly down between the panels 14 and 15, so that the heat generated by the heating element 22 can have access to the trough 59 and heat it up. The trough 59 is intended to be filled with water, and the heat from the heating element 22 will have the effect of vaporising water at a greater or lesser extent, whereupon the water vapor can pass out of the reservoir and into the space around the ends of the elongated members 16.

Figure 2:
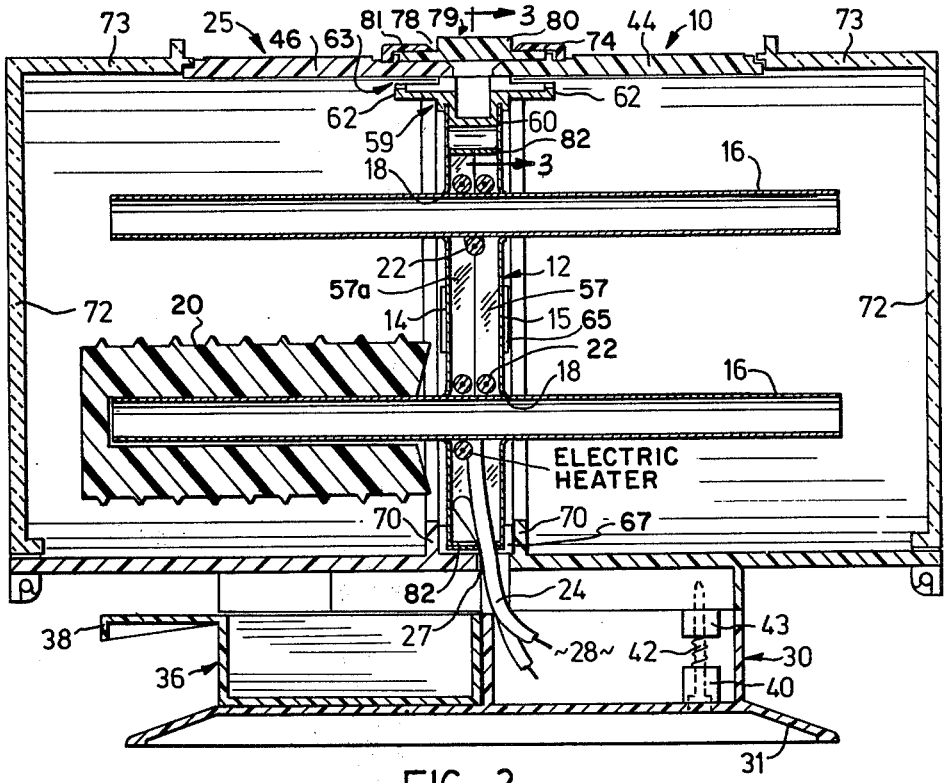
FIG. 2 is a section taken through the apparatus of FIG. 1 in assembled condition, the section being taken on a vertical plane parallel with the direction of the elongated posts visible in FIG. 1.
Figure 3:
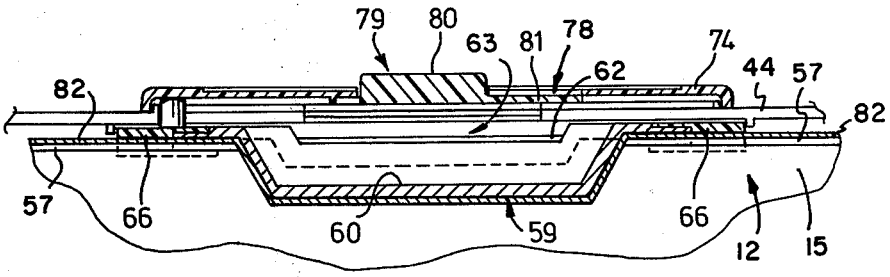
FIG. 3 is a sectional view taken at the line 3—3 in FIG. 2.

As can be seen best in FIGS. 2 and 3, the reservoir includes lateral flanges 62 which do not touch the housing portions 44 and 46, but leave a gap 63 through which water vapor can escape from the reservoir and gain access to the region of the ends of the elongated members 16.

The edges of the flanges of the panels 14 and 15 are juxtaposed, so as to substantially enclose the space in which the heating element 22 is located.

Retaining the panels 14 and 15 in the juxtaposed position are five clips which include side clips 65, top clips 66, and a bottom clip 67. Each of these clips is in the shape of a square "C" and is adapted simply to snap over the edges of the panels 14 and 15. The top clips 66 additionally enclose the ends of the reservoir 59, as can be seen in FIG. 3.

Turning now to the housing 25, it will be seen that each of the housing portions 44 and 46 is in the shape of a substantially rectangular sleeve with rounded corners. The upper outer edge of each sleeve has a cutaway portion 69, and the two portions are adapted to mate together around and enclosing the central wall 12. To this end, each of the portions 44 and 46 has a slightly inwardly offset flange 70 running all the way around the inside of the housing portion, except for the top, the top portion being missing in order to allow egress of the vapor from the reservoir 59. Thus, when the housing portions 44 and 46 are placed together in juxtaposition, the flanges 70 enclose and hold in position the central wall 12 defined by the panels 14 and 15.

Hinged to the outside of each housing portion 44 and 46 is a transparent plastic door 72, each of which has a flange 73 adapted to fit within and close the cut-away portion 69 in the respective housing portion 44 and 46.

The apparatus further includes a plate member 74 which is adapted to fit down on top of the two housing portions 44 and 46 when these are in juxtaposition, and to register in appropriately shaped recesses 75 formed integrally atop each of the housing portions 44 and 46. Within the recesses are located four apertures 76 into which four registry tabs 77 on the plate member 74 are adapted to fit. The plate member defines an opening 78 and there is further provided a manual slide member 79 which includes a finger button 80 and a flange portion 81, the latter being designed such that the flange portion 81 can be lodged between the plate member 74 and the adjacent parts of the housing portions 44 and 46, with the manual finger button 80 extending upwardly through the opening 78. When the finger button 80 is pushed to the left as seen in FIG. 1, the opening 78 is revealed, and the user can fill the reservoir 59 with water. After filling, the finger button is moved again to the right, to close the opening 78, so that as water evaporates from the reservoir 59, it will not escape from the apparatus as a whole, but will be directed to the space enclosed by the housing portions 44 and 46 and surrounding the ends of the elongated members 16.

Shown in FIG. 1 is an adhesive tape 82 which is wrapped around the join between the two panels 14 and 15 and passes under the metallic reservoir 59. The purpose of the tape 82 is to prevent water from entering the space between the panels 14 and 15.

I claim:

1. A compact apparatus for heating and setting hair, comprising:

a central wall defined by two spaced-apart panels, a plurality of heat-conductive elongated members, each passing through a separate pair of aligned apertures in said panels, and the free ends of each member extending away from the central wall in two opposing directions, a plurality of hair-curling cylinders each having a central axial passageway adapted to receive an end of one of said elongated members, a flexible rope-like heating element between the two spaced-apart panels and wound around each of the elongated members, wire means connected with said heating element, by which electrical energy can be conveyed to the heating element from an external source, said housing means enclosing the central wall, the elongate members, the heating element, and the cylinders when engaged with the elongated members.

2. The apparatus claimed in claim 1, in which the elongated members are hollow, open-ended, metallic tubes.

3. The apparatus claimed in claim 2, in which said tubes are of aluminum.

4. The apparatus claimed in claim 1, claim 2 or claim 3, in which each of the elongated members extends equally to both sides of the central wall and is perpendicular thereto.

5. The apparatus claimed in claim 1, claim 2 or claim 3, in which the housing means is adapted to rest upon any supporting surface in a given orientation, and in which the central wall, when the housing means is in said given orientation, is perpendicular to the supporting surface.

6. The apparatus claimed in claim 1, in which each of the elongated members extends equally to both sides of the cental wall and is perpendicular thereto, and in which the housing means is adapted to rest upon any supporting surface in a given orientation, the central wall being perpendicular to the supporting surface when the housing means is in said given orientation, and having a top edge.

7. The apparatus claimed in claim 1, claim 2 or claim 6, further including an upwardly open metallic reservoir for water located at an edge of said central wall which is uppermost when the housing means is in said given orientation, whereby heat generated by the heating element can rise and vaporize water in said reservoir, the apparatus being so constructed that water vapor from said reservoir can pass into those parts of the housing means which enclose the free ends of the elongated members.

8. The apparatus claimed in claim 1, claim 2 or claim 6, further including an upwardly open metallic reservoir for water located at an edge of said central wall which is uppermost when the housing means is in said given orientation, whereby heat generated by the heating element can rise and vaporize water in said reservoir, the apparatus being so constructed that water vapor from said reservoir can pass into those parts of the housing means which enclose the free ends of the elongated members, the housing means including an opening directly above the reservoir for allowing water to be added to said reservoir, and a closure member which can be moved manually between a position in which it closes the opening and a position in which it leaves the opening open.

9. The apparatus claimed in claim 1, claim 2 or claim 6, in which each of the two spaced-apart panels has flanged edge portions, the flanged edge portions of each panel extending toward the other panel, the peripheries of the edge portions of the panels being in juxtaposition.

10. The apparatus claimed in claim 6, in which each panel has a marginal flange directed perpendicularly to its main extent and projecting toward the other panel, the flange extending around the full periphery of the respective panel except for a part near said top edge of the panel, the apparatus including an upwardly open, metallic reservoir for water located along the top edge of the panels at said part where the flange is absent, whereby heat generated by the heating element can rise and vaporize water in said reservoir, the flanges having their edges juxtaposed.

* * * * *

UNITED STATES PATENT AND TRADEMARK OFFICE

Certificate

Patent No. 4,298,787 Patented November 3, 1981

George Barradas

Application having been made by George Barradas the inventor named in the patent above-identified, and Appliance Design Probe Inc., the assignee, for the issuance of a certificate under the provisions of Title 35, Section 256, of the United States Code, adding the name of Harvey Levine as a joint inventor, and a showing and proof of facts satisfying the requirements of the said section having been submitted, it is this 6th day of Mar., 1984, certified that the name of the said Harvey Levine is hereby added to the said patent as a joint inventor with the said George Barradas.

Fred W. Sherling,
*Associate Solicitor.*